US006330304B1

(12) United States Patent
Warburton

(10) Patent No.: US 6,330,304 B1
(45) Date of Patent: Dec. 11, 2001

(54) VERTICAL ROTOR BRAZE JOINT WITH RETENTION CHAMFER

(75) Inventor: Don Warburton, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/561,730

(22) Filed: Apr. 28, 2000

(51) Int. Cl.[7] ..... H01J 35/10
(52) U.S. Cl. ..... 378/131; 378/144
(58) Field of Search ..... 378/119, 121, 378/125, 131, 144

(56) References Cited

U.S. PATENT DOCUMENTS 5,838,762 * 11/1998 Ganin et al. ..... 378/125
6,088,426 * 7/2000 Miller ..... 378/144

FOREIGN PATENT DOCUMENTS

60020433 * 2/1985 (JP) .

* cited by examiner

*Primary Examiner*—David P. Porta
(74) *Attorney, Agent, or Firm*—Workman, Nydegger & Seeley

(57) ABSTRACT

The present invention relates to a rotor shaft and rotor body assembly in an x-ray device, and it method of manufacture, that resists the formation of cracks in the braze joint due to the elimination of horizontal shear planes therein. The inventive structure also comprises an enlarged proximal end of the rotor shaft and an inventive assembly method that prevents the rotor shaft from de-coupling from the rotor body should the braze material entirely fail during field use.

27 Claims, 7 Drawing Sheets

VERTICAL ROTOR BRAZE JOINT WITH RETENTION CHAMFER

BACKGROUND OF THE INVENTION

1. The Field of the Invention

The present invention relates to x-ray tubes having rotating anode structures. In particular, embodiments of the present invention relate to structures and assembly methods for a rotor shaft and rotor body assembly of an x-ray tube rotating anode.

2. The Relevant Technology

X-ray producing devices are extremely valuable tools that are used in a wide variety of applications, both industrial and medical. Such equipment is commonly used in areas such as diagnostic and therapeutic radiology; semiconductor manufacture and fabrication; and materials testing.

The basic operation of typical x-ray producing equipment is similar. In general, x-rays, or x-radiation, are produced when electrons are released, accelerated, and then stopped abruptly. A schematic representation of a typical x-ray tube is shown in FIG. 1. The illustrated x-ray tube assembly 1 includes three primary elements: a cathode 2, which is the source of electrons; an anode 3, which is axially spaced apart from the cathode and oriented so as to receive electrons emitted by the cathode; and a voltage generation element for applying a high voltage potential to accelerate the electrons from the cathode to the anode.

The three elements are usually positioned within an evacuated housing 4. An electrical circuit is connected so that the voltage generation element can apply a high voltage potential (ranging from about ten thousand to in excess of hundreds of thousands of volts) between the anode (positive) and the cathode (negative). The voltage differential causes the electrons that are emitted from the cathode 6 to form a beam and accelerate towards an x-ray "target" that is positioned on the surface of a anode disk 5. The target surface (sometimes referred to as the focal track) is comprised of a refractory metal, and when the electrons strike the target at the focal spot, the kinetic energy of the striking electron beam is converted to electromagnetic waves of very high frequency, i.e., x-rays. The resulting x-rays emanate from the anode target, and are then collimated through a window 9 for penetration into an object, such as an area of a patient's body. As is well known, the x-rays that pass through the object can be detected and analyzed so as to be used in any one of a number of applications, such as x-ray medical diagnostic examination or material analysis procedures.

In addition to producing x-rays, when the electrons impact the target surface much of the resulting energy is converted to heat. This heat, which can reach extremely high temperatures, is initially concentrated in the anode target and then dissipated to other areas of the x-ray tube. These high operating temperatures can damage the x-ray tube, especially over time.

The anode disk 5 (also referred to as the rotary target or the rotary anode) is rotatably mounted on a rotating nose piece or stem and rotating shaft 11, which is connected to a supporting rotor assembly 7. The disk 5, shaft and rotor assembly are rotated by a suitable means, such as a stator motor 8. The disk is typically rotated at high speeds (often in the range of 10,000 RPM), thereby causing the focal track to rotate into and out of the path of the electron beam. In this way, the electron beam is in contact with specific points along the focal track for only short periods of time, thereby allowing the remaining portion of the track to cool during the time that it takes the portion to rotate back into the path of the electron beam.

It will be appreciated that the need to continuously accelerate and rotate the disk at such high speeds in the presence of extremely high temperatures can give rise to a number of problems. For instance, while the rotation of the track helps reduce the amount and duration of heat dissipated in the anode target, the focal track is still exposed to very high temperatures—often temperatures of 2500° C. or higher are encountered at the focal spot of the electron beam. This heat is transferred to other portions of the x-ray tube assembly, including the shaft and rotor assembly, resulting in extreme thermal stresses at the interfaces between the various structures. Moreover, acceleration and deceleration of the relatively heavy anode disk results in severe mechanical stresses being imposed on the rotor assembly. Unfortunately, the structures and assembly methods used for anode disk rotational assemblies have not been entirely satisfactory in addressing the various problems arising from such mechanical and thermal stresses.

For example, a rotor shaft and rotor body assembly have typically been interconnected by way of threads formed on an outer portion of the rotor, which is then received within a corresponding threaded bore formed within a portion of the rotor body. In addition, a brazed joint may be applied between the threaded mating surfaces. Also, a screw, pin, or the like may be used to secure the rotor shaft to the rotor, which assures that the rotor shaft does not detach from the rotor body in the event that the threaded engagement/braze joint fails. Finally, the rotor shaft may be further welded to rotor body by use of an electron beam welding method.

It will be appreciated these types of manufacturing steps are time consuming, expensive, and can result in an assembly with multiple points of potential failure. For instance, the formation of a threaded rotor shaft and corresponding mating rotor body, along with the placement of a screw or the like, entails intensive machining and assembly. Additionally, the placement of a screw or similar fastening means may itself be an operation that is subject to occasional defects. Also, electron beam welding can cause brittleness at the weld that may lead to structural failure, which is made even more likely due the extreme temperature fluctuations that are encountered during operation of the x-ray tube. Finally, each of these techniques entail expensive and time consuming manufacturing steps, which increase the overall production cost of the x-ray tube device.

The types of materials that are typically used in the construction of a rotor shaft and rotor body can also give rise to problems. For instance, to restrict the flow of heat by conduction into the rotor shaft and rotor body assembly from the rotating anode target disk, the rotor shaft is often provided with a minimum cross-sectional size and is generally made of a relatively poor heat conductive material, such as a molybdenum alloy called TZM. TZM comprises about 99% molybdenum with the balance making up various proportions of titanium and zirconium. While the TZM material exhibits superior structural strength, it can have a different linear coefficient of thermal expansion than the material making up rotor body 14. For instance, the rotor body is often made of an iron alloy such as Incoloy 909 sold by Inco Alloys International Inc. of Huntington, W. Va., which has a linear thermal expansion coefficient that is slightly different from that of TZM. This can give rise to significant structure-weakening events during operation, due to the varying rate of thermal expansions of the two materials.

Also, where the rotor body is constructed of iron or an iron alloy material, the extreme temperature fluctuations can cause such an iron-based alloy to experience allotropic transformation from body centered cubic (bcc) to face centered cubic (fcc). For instance, when rising through about 912° C., iron transforms from bce to fcc and consequently shrinks in volume. Therefore, in addition to disparate linear thermal expansion coefficients, allotropic transformations cause additional stress upon a braze joint at the interface between rotor shaft and rotor body.

Many of these problems can be manifested during repeated operation of the x-ray tube. During operation, the rotor shaft begins to heat up and mechanical stresses from high rotational speeds are imposed. For instance, when the rotor shaft is connected to the rotor assembly with a threaded interface and a braze joint, a horizontal thermal shear plane is often produced at the threaded interface between the shaft and the rotor body within the braze joint. This thermal shear stress can be transferred through the braze material. Moreover, the condition is exacerbated if rotor body 14 is made of iron or an iron alloy, and is taken through the allotropic transformation temperature threshold of about 912° C., as noted. Over time, this continuous cycle of expansion and contraction can result in a cracks or other failure points in the joint. Once a crack has nucleated, propagation of the crack typically results, ultimately resulting in failure of the x-ray tube.

Other problems can also result when traditional methods are used to interconnect the rotor assembly. For instance, the braze joint is often comprised of a braze material that will readily flow along and between the threaded surfaces of the rotor shaft and the rotor body. In the event that the braze material has a melting temperature above 1150° C., the molybdenum component of the TZM material forming the rotor shaft forms a eutectic with the metal component of the brazing material, that in turn produces an intermetallic compound. This compound can be brittle in comparison to most metals at room temperature, and can become more ductile as the temperature increases, where conventional metals may tend to allotropically transform and fail or even reach liquidus temperatures. Alternatively, if the braze material has a melting temperature below about 900° C., the braze joint may soften during operation of the x-ray tube and fail to withstand the resulting mechanical stresses.

Thus, what is needed is a rotor shaft and rotor body assembly that overcomes the problems of the prior art. In particular, it would be advantageous to have a rotor shaft and rotor body assembly that are interconnected in a manner so as to better withstand the extremely high temperatures and mechanical stresses imposed during operation of the x-ray tube. Additionally, it would be advantageous to provide a rotor shaft and rotor body assembly that are interconnected in a manner so as to resist cracking within the braze joint. Also, it would be advantageous to provide a interconnection scheme that is easy and low in cost to implement and manufacture.

SUMMARY AND OBJECTS OF THE INVENTION

It is therefore a primary object of the invention to provide a rotor shaft and rotor body assembly that overcomes the problems of the prior art, namely, to provide an assembly that is better able to withstand the mechanical and thermal stresses generated in an operating x-ray tube. It is also an object of embodiments of the invention to provide a rotor shaft and rotor body assembly that substantially eliminates the presence of horizontal thermal shear planes in the braze between a rotor shaft and rotor body assembly. Still another object of embodiments of the present invention is to provide a rotor shaft and rotor body assembly having a rotor shaft that is implemented so as to resist decoupling from the rotor body, even in the presence of high temperatures, high operational speeds, and repeated and prolonged operation. It is also an object of the present invention to provide a method of assembling a rotor shaft and rotor body that is simplified, and that uses fewer complex and time consuming assembly steps.

These and other objectives are addressed by the present invention, which relates to a rotor shaft and rotor body assembly that maintains structural integrity through extreme temperature fluctuations, and in the presence of severe mechanical stresses. As noted, in a rotating anode x-ray tube, a rotor shaft and rotor body assembly experiences temperature changes between room temperature and 1,000° C. and higher during routine usage. Moreover, the assembly is subjected to dramatic mechanical stresses resulting from the high rotational speeds. In one preferred embodiment of the present invention, these problems are addressed with a rotor shaft and rotor body assembly that eliminates the occurrence of horizontal thermal shear planes that are otherwise present at connection points between the shaft and rotor body in the prior art. The assembly also eliminates catastrophic decoupling of the rotor shaft and rotor body, without the use of a screw or the like.

A first embodiment of the present invention includes a rotor shaft having an end that has an enlarged convex profile such as a chamfer or a flange. Formed within a corresponding end of the rotor body is an inner bore or recess that has an enlarged concave profile that is complimentary in size and shape to the rotor shaft enlarged convex profile. When assembled, the shaft chamfer or flange on the shaft is matingly received within the recess of the rotor body. In the preferred embodiment, a braze joint is then formed between the mated rotor shaft end and the recess of the rotor body. Moreover, the orientation of the shaft and rotor ensure that the braze joint is predominantly axially disposed between the shaft and the rotor body. Also, the braze joint can be formed to be substantially vertical, thereby eliminating any horizontal thermal shear planes between the shaft and the rotor joint. Various other embodiments vary the shape, size and/or configuration of the rotor shaft end and the corresponding mating surface within the rotor body. These various configurations provide different attachment characteristics, and allow for different types of braze joint configurations.

Embodiments of the present invention also include a method of assembling a rotor body and a rotor shaft system. For instance, one assembly method comprises the insertion of a distal end of the rotor shaft entirely through a bore formed within the rotor body until the enlarged convex profile of the rotor shaft seats against the complimentary contour of the recess found within the rotor body. The two ends can then be affixed with the application of a braze joint.

These and other objects, features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to a rotor shaft and rotor body assembly suitable for use in a x-ray device having a rotating anode. In particular, presently preferred embodiments significantly reduce or eliminate thermal expansion and contraction shear stresses in the brazed interface between the shaft and the rotor body. In addition, embodiments of the present invention also provide an improved interconnection between the rotor shaft and the rotor body assembly that resists decoupling in the event of a catastrophic failure of the braze material between the two components.

Reference will now be made to the drawings wherein like structures will be provided with like reference designations. It is to be understood that the drawings are diagrammatic and schematic representations of presently preferred embodiments of the present invention, and are not necessarily drawn to scale.

Figure 1:
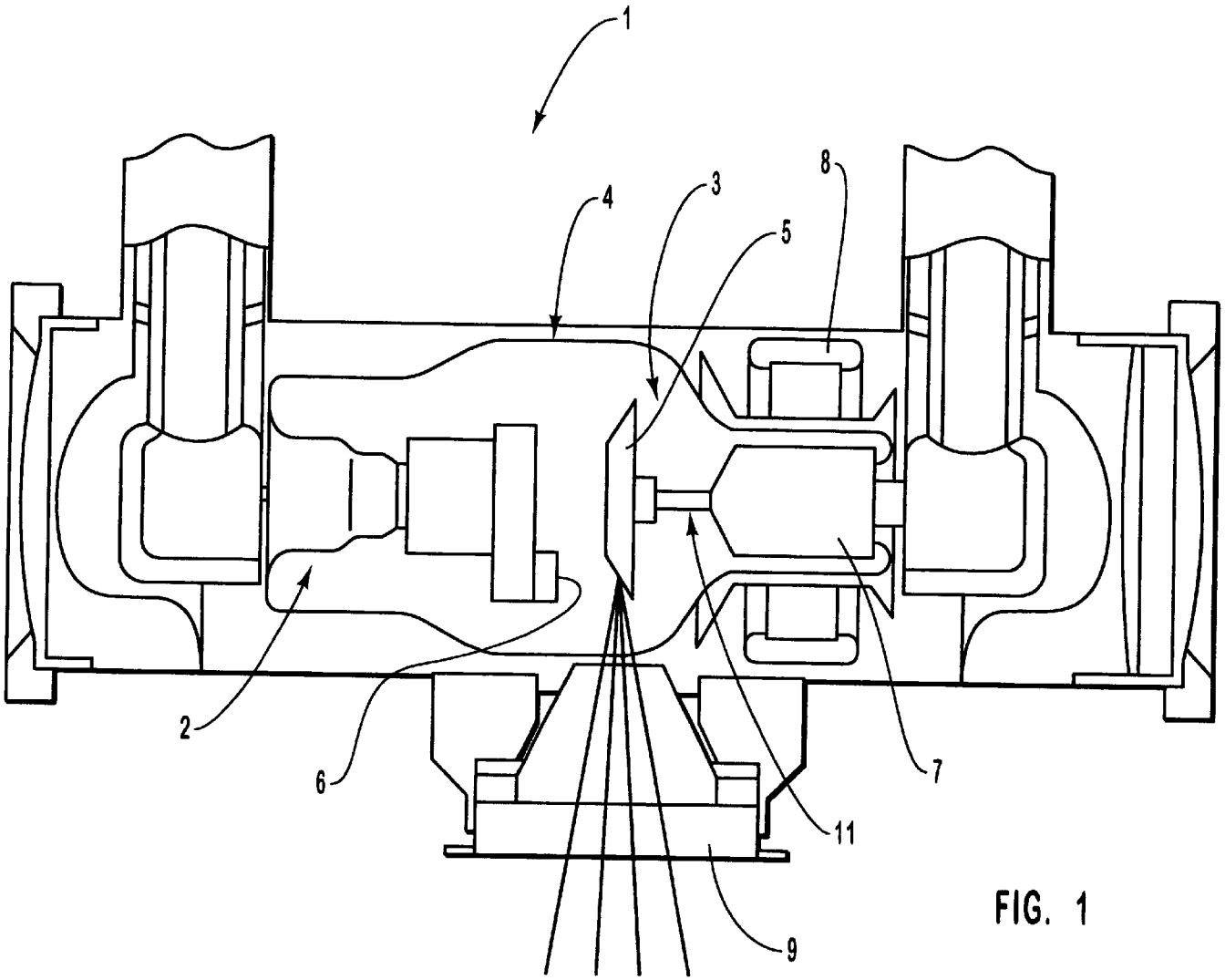
FIG. 1 is a cut-away perspective view of a conventional x-ray tube assembly.
Figure 2:
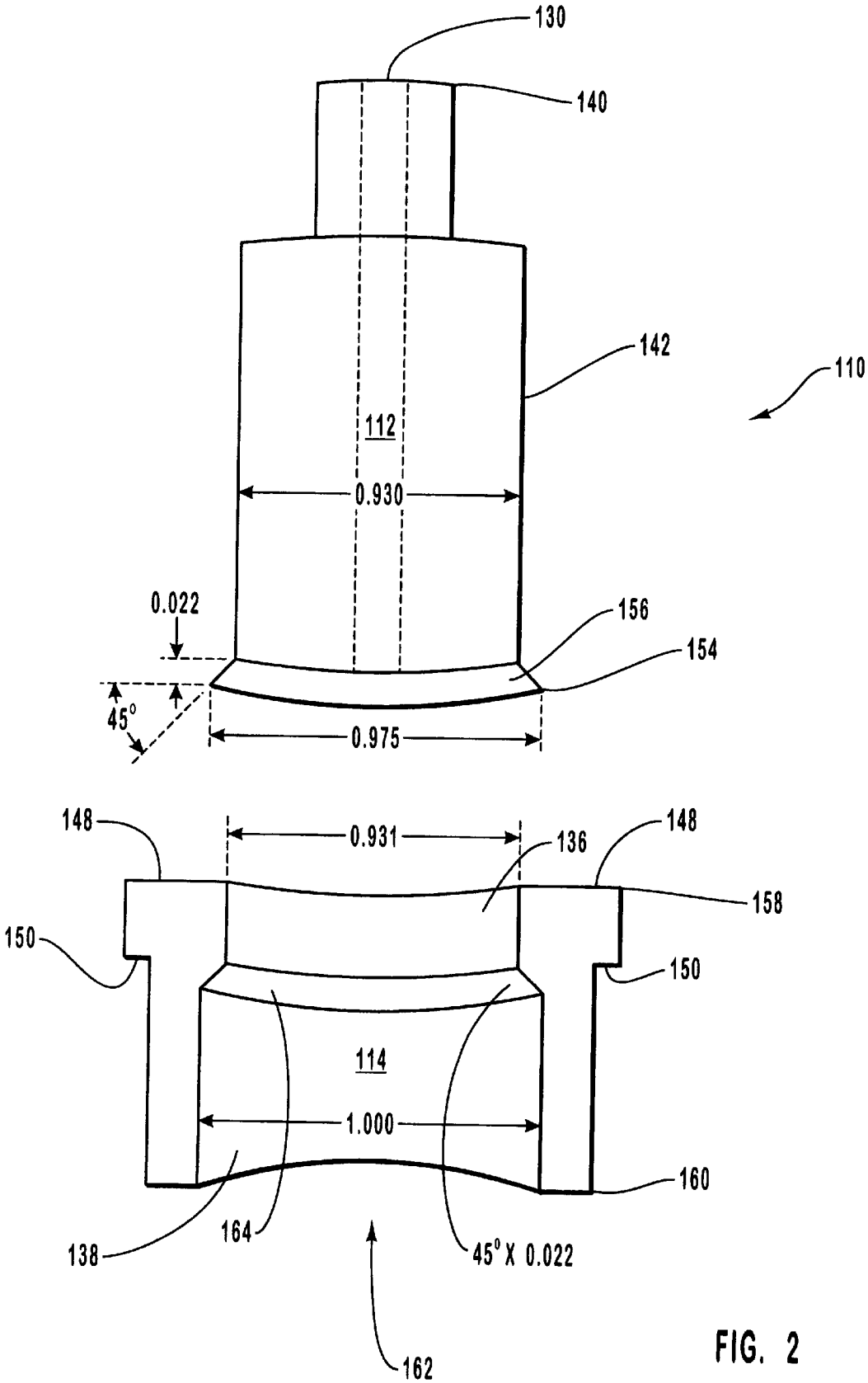
FIG. 2 is an exploded perspective view of one presently preferred embodiment of a rotor shaft and rotor body assembly, wherein a cut-away view of the rotor body reveals a rotor body inner bore and a rotor body outer bore that are separated by a rotor shaft chamfer seat.

FIG. 2 is a perspective view of a presently preferred embodiment of a disassembled rotor shaft and rotor body assembly 110 constructed in accordance with teachings of the present invention. The rotor shaft and the rotor body assembly 110 comprise a cylindrical rotor shaft 112 having a reduced diameter towards the distal end 140, and an enlarged diameter towards the proximal end 154. Formed at the distal end 154 is a rotor shaft chamfer section 156. Formed within rotor shaft 112 is bore 130, as is designated via phantom lines. Also shown is a rotor body 114, which is also cylindrical in shape. A cut-away view of rotor body 114 reveals a rotor body inner bore 136 and a rotor body outer bore 138, axially disposed within rotor body 114, and separated by a rotor shaft chamfer seat 164.

Assembly of the rotor shaft 112 and the rotor body 114 of FIG. 2 requires the rotor shaft 112 to pass through rotor body 114 with the distal end 140 first, from below the rotor body 114.

Figure 4:
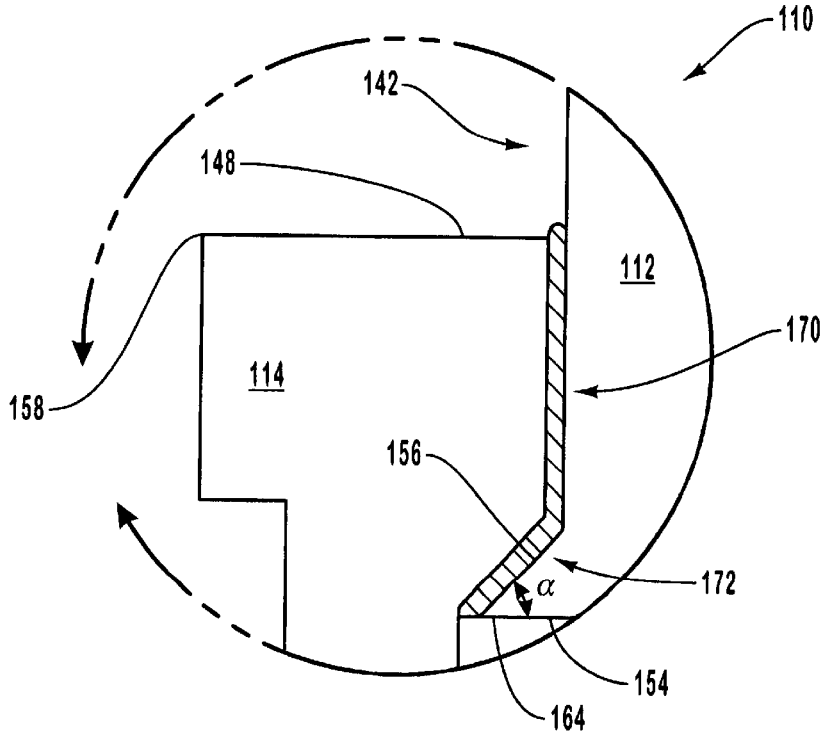
FIG. 4 is a detail section taken from FIG. 3, wherein the assembly is illustrated at the braze joint.

The rotor shaft chamfer 156 has a diameter that exceeds the diameter of rotor body inner-bore 136. Consequently, when the rotor shaft 112 distal end 140 is passed through rotor body outer bore 138, past rotor shaft chamfer seat 164, the rotor shaft chamfer 156 seats against rotor shaft chamfer seal 164. For dimensional analysis purposes, the dimensions depicted in FIG. 4 are in arbitrary units, but they may be considered to be in inches by way of non-limiting example.

In a preferred embodiment, rotor shaft 112 is made of molybdenum or a molybdenum alloy called TZM or another refractory or alloy. TZM comprises about 99% molybdenum with variable fractional percentages of titanium and zirconium. The TZM material exhibits superior structural strength to pure molybdenum material, it is easier to machine, and it withstands the centrifugal stresses imposed upon it during rotation and cycling through a thermal change from approximately room temperature to about 900° C. and above, returning to room temperature.

Figure 3:
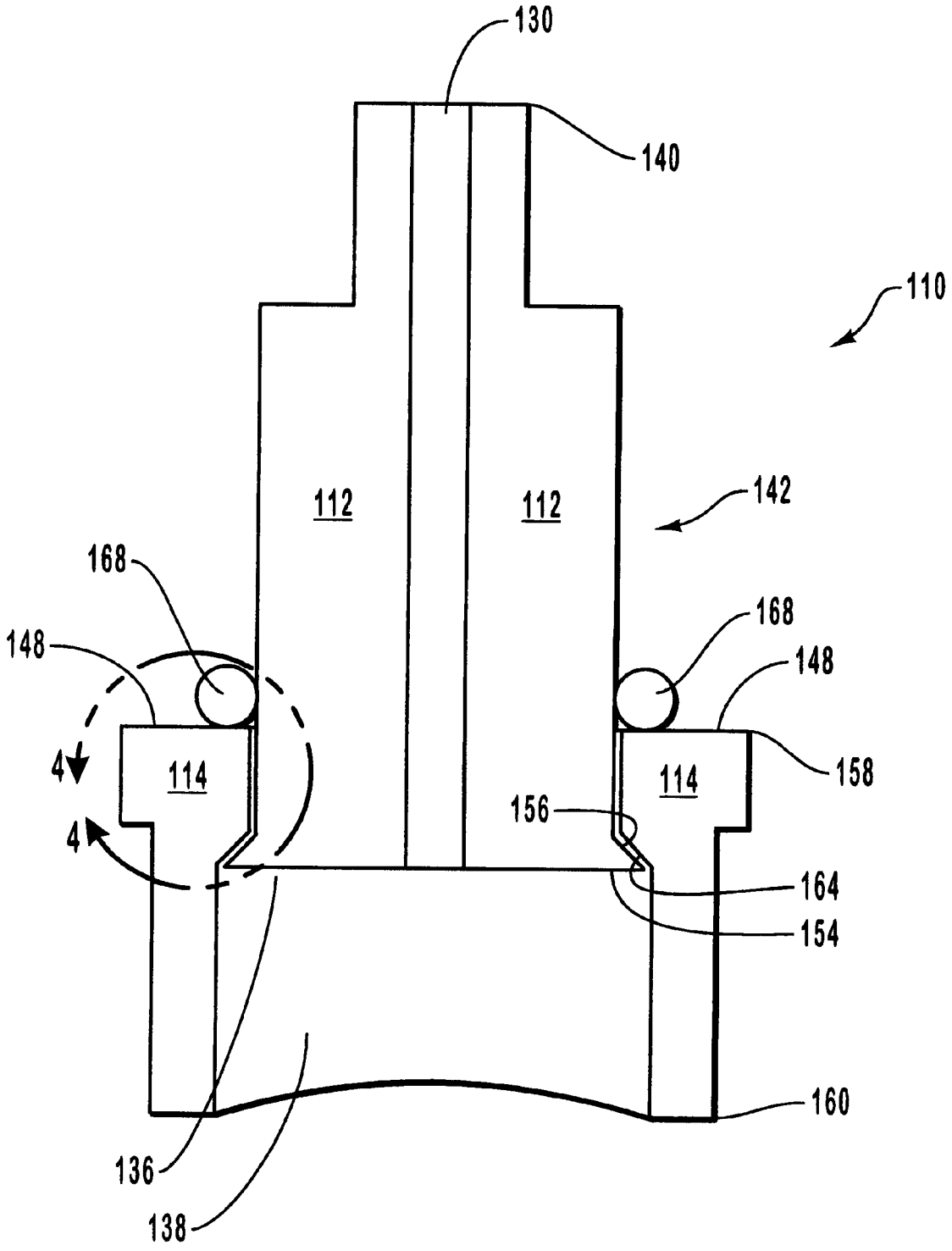
FIG. 3 is a cut-away perspective view of the rotor shaft and rotor body assembly of FIG. 2, wherein it can be seen that the rotor shaft chamfer is disposed against the rotor body chamfer seat in preparation for brazing by melting of a braze ring.

FIG. 3 illustrates the rotor shaft and rotor body assembly 110 in an elevational cut-away cross section immediately prior to brazing the rotor shaft 112 to the rotor body 114. It can be seen that the interface between the rotor shaft 112 and the rotor body 114 is entirely devoid of any horizontal thermal shear planes. In this embodiment, the lack of any horizontal thermal shear planes is made possible by the interface of the right-cylinder shape of the rotor shaft main section 142 within the rotor body inner bore 136 and the diagonal, frusto-conical interface between the rotor shaft chamfer seat 164 and the rotor shaft chamfer 156. A braze ring 168 is depicted as sitting against the rotor shaft main section 142 and simultaneously sitting upon proximal surface 148 of the rotor body 114 adjacent the rotor shaft main section 112.

In order to achieve a reliable braze joint between the rotor body 114 and the rotor shaft 112, it is preferable to configure respective diametric sizes that provide an interposed gap when the rotor shaft 112 is fully inserted upwardly through the rotor body 114 until the rotor shaft chamfer 156 seats against the rotor shaft chamfer seat 164. In a presently preferred embodiment, the gap that forms the interface between the rotor shaft 112 and the rotor body 114 may have a dimension in the range of about 100 mils to about 1,000 mils in order to provide spacing that will facilitate capillary action wetting as braze ring 168 liquefies and fills into the gap to form the braze. Various suitable braze materials are well known in the art. Examples of preferred brazing materials may be found in U.S. Pat. Nos. 4,736,400 and 4,969,172, the disclosures of which are incorporated herein by specific reference. Preferably, the brazing material has a melting temperature so that it doesn't melt under ordinary operating temperatures of the x-ray tube. The brazing material may also be a composition that forms an intermetallic with rotor shaft 112 and/or rotor body 114. At room temperature, an intermetallic composition is brittle relative to traditional metals, but at elevated temperatures where traditional metals begin to soften and/or melt, an intermetallic begins to behave as a traditional metal with favorable ductility, tensile, and compressive qualities at operating temperatures in the range from about 700° C. to about 1,200° C. and higher.

In an alternative embodiment of the present invention, the rotor shaft and the rotor body assembly 110, depicted in FIG. 3, is assembled entirely without braze material. Tolerances are chosen between the convex right-cylinder interface of the rotor shaft main section 142 and the concave right-cylinder shape of the rotor body inner bore 136 such that the rotor shaft and rotor body assembly 110 can be assembled only by applying force to push the rotor shaft 112 into the rotor body inner bore 136, and thereby provide a tight and frictionally secure fit between the two.

Another preferred method of making the rotor shaft and rotor body assembly 110 without the presence of a braze material is to heat the rotor body 114 to a temperature sufficiently high such that thermal expansion allows for rotor shaft 112 to pass substantially through rotor body inner bore 136 until the chamfer 156 abuts against rotor shaft chamfer seat 164. As the rotor body 114 cools, the interface between the rotor shaft 112 and the rotor body 114 become increasingly tight due to the thermal contraction of rotor body 114. Once the rotor shaft and rotor body assembly 110 have substantially cooled to room temperature following assembly, field use thereof will not substantially diminish the tightness of the fit of the rotor shaft 112 within the rotor body because both the rotor shaft 112 and the rotor body will be heated and cooled substantially as a unit. In this embodiment, a failure of rotor shaft and rotor body assembly 110 would require either the rotor body 114 to crack under tensile stress or the rotor shaft 112 to crack under compressive stress. Preferred temperature differentials between the rotor body 114 and the rotor shaft 112 for this type of assembly process are in a range from about 0° C. to 900° C., and in a preferred embodiment are between about 200° C. to about 350° C. The coefficient of static friction between the rotor shaft 112 and the rotor body 114 is sufficient to hold assembly 110 together, similar to the use of the braze material. As an alternative embodiment, brazing may be done in addition to the tight fit.

FIG. 4 is a detail section taken along the dashed line 4—4 from FIG. 3, in which it can be seen that a vertical braze joint 170 and a diagonal braze joint 172 form a continuous braze interface between the rotor shaft 112 and the rotor body 114 beginning at the proximal surface 148 where braze ring 168 (see FIG. 3) was located, and ending approximately at rotor shaft proximal end 154.

In comparison to the type of braze joints utilized in the prior art and discussed above, no horizontal thermal shear plane is present between the shaft 112 and the rotor body 114. Additionally, as the rotor shaft 112 heats by conduction from the rotating anode target disk, thermal expansion of the rotor shaft 112 exerts only a compressive stress upon the braze at vertical braze joint 170. Similarly, during temperature escalation of the rotor shaft and rotor body assembly 110, and where the rotor body 114 experiences an allotropic phase transformation from bcc to fcc, additional non-shear stresses upon the vertical braze joint 170 may be experienced.

It can be seen that a diagonal braze joint 172 completes the braze that connects the rotor shaft 112 with the rotor body 114. The diagonal braze joint 172 may carry a horizontal thermal shear component that is proportional to the compressive stress in the vertical brazed joint 170 multiplied by the cosine of the angle $\alpha$. The total amount of horizontal thermal shear experienced between the rotor shaft chamfer 156 and the rotor shaft chamfer seat 164 is minimal and substantially nondestructive compared to stresses existing in structures of the prior art. One possible reason for this is that the heating of the rotor body 114 begins substantially at the proximal surface 148 across vertical braze joint 170, and then continues downward in both the rotor shaft 112 and the rotor body 114. This heat conduction pattern ensures that the thermal gradients within the diagonal braze joint 172 cause substantially only compressive stresses to occur.

The angle $\alpha$ designated in FIG. 4 defines the contour of the rotor shaft chamfer 156 in relation to the axial configuration of the rotor shaft main section 142. The angle may be varied to minimize a horizontal thermal shear component within diagonal braze joint 172. For instance, as the angle $\alpha$ becomes larger and approaches 90°, any horizontal thermal shear component within diagonal braze joint 172 approaches zero. In presently preferred embodiments, the value for angle $\alpha$ is in a range from about 30° to about 80°, and in one embodiment is in a range from about 60° to about 70°.

A primary purpose for the rotor shaft chamfer 156 is to retain the rotor shaft 112 within the rotor body 114, even in the event that the braze 170 or 172 fails due to a crack. As such, the angle $\alpha$ need only be any angle less than 90° that will facilitate retention of rotor shaft 112 within rotor body 114 under the operating conditions of the particular x-ray device. Rotor shaft chamfer 156, with the above-discussed configurations of angle $\alpha$, is one example of a means for retaining the rotor shaft in the rotor body.

Figure 5:
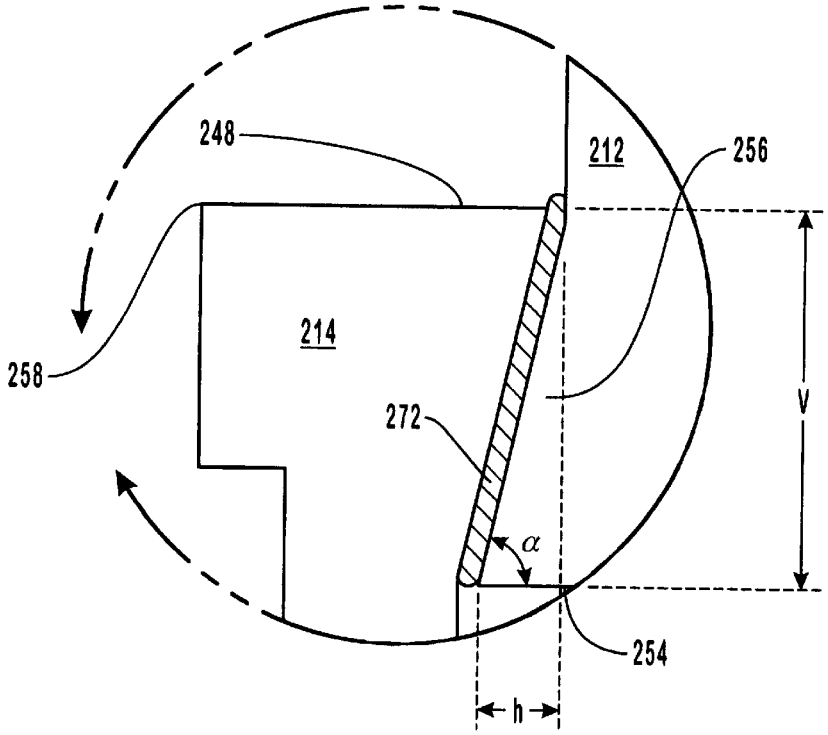
FIG. 5 is a detail section taken from FIG. 3, wherein an alternative embodiment is illustrated at the braze joint.

FIG. 5 illustrates another embodiment of the present invention, which illustrates how the size and shape of the rotor shaft chamfer may be varied in its vertical height, v, and in its horizontal extension, h, in relation to the rest of the rotor shaft. In FIG. 5, the rotor shaft 212 has a rotor shaft chamfer 256 that originates substantially at the same height as the proximal surface 248 of the rotor body 214, and that terminates at the rotor shaft proximal end 254. The vertical height, v, of the rotor shaft chamfer 256 corresponds to the distance between the rotor shaft proximal end 254, and the rotor body proximal end 258, which is also at the same height as the proximal surface 248. A diagonal braze joint 272 comprises the entire braze that attaches the rotor shaft 212 to the rotor body 214. Again, the angle $\alpha$ determines the amount of a horizontal thermal shear component that may be experienced within the diagonal brazed joint 272. Where the horizontal extension, designated as h, is sufficiently small such that angle $\alpha$ approaches 90°, any horizontal thermal shear component experienced within the diagonal braze joint 272 approaches zero. Where the vertical height v of rotor shaft chamfer 256 begins at rotor shaft proximal end 254 and terminates at the level of the rotor body proximal end 258, the angle $\alpha$ may be small. For example, in this illustrated embodiment angle $\alpha$ may be in a range from about 30° to about 89°, and preferably is from about 60° to about 89°.

Figure 6:
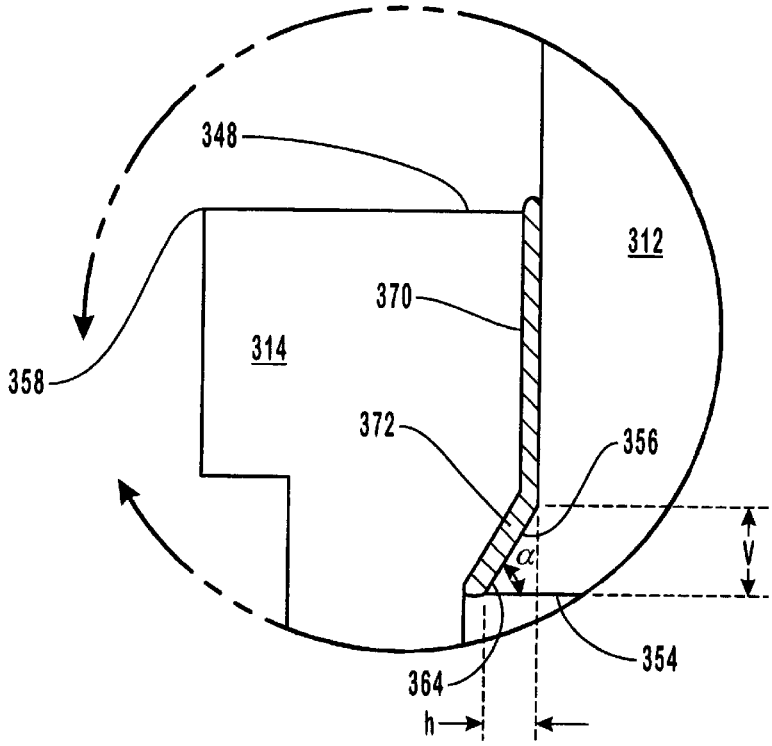
FIG. 6 is a detail section taken from FIG. 3, wherein yet another alternative embodiment is illustrated at the braze joint.

FIG. 6 is a detail section taken from a structure at a location similar to that taken from FIG. 3, and illustrates another embodiment of the present invention. Here, the vertical height v of the diagonal braze joint 372 depicted between the rotor shaft chamfer 356 and the rotor body chamfer seat 364 is minimized due to the relatively larger height of a vertical braze joint 370. Diagonal braze joint 372 is therefore present as a minor portion of the braze. In this embodiment, vertical height, v of the rotor shaft chamfer 356 is minimized and angle $\alpha$ is maximized to approach 90°. While the structure depicted in FIG. 6 may not have the same capability to retain rotor shaft 312 upon catastrophic failure of the braze, it does minimize the extent of diagonal braze joint 372 and therefore minimizes any horizontal thermal shear component that may occur therewithin. In one preferred embodiment, vertical height v has a value of approximately 0.022 inches, and angle $\alpha$ has a value in a range from about 45° to about 89°, and preferably is between about 75° to about 89°.

Figure 7:
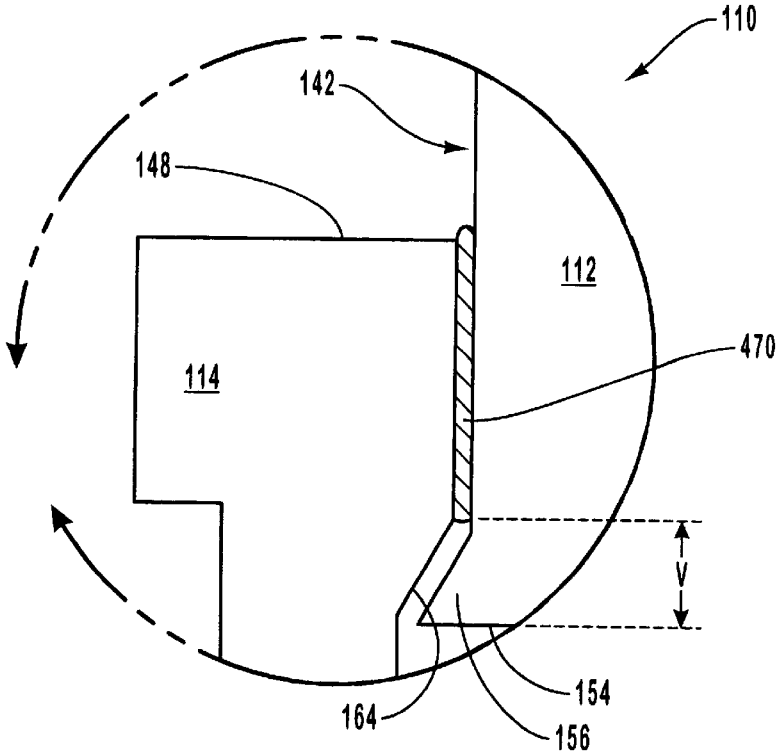
FIG. 7 is a detail section taken from a structure similar to the location depicted in FIG. 3, wherein an alternative embodiment is illustrated to demonstrate a vertical braze joint with no horizontal or diagonal braze joints present.

The rotor shaft chamfer in connection with the rotor body may be implemented with other structures. FIG. 7 is a detail section illustrating one such embodiment. In FIG. 7, an amount of a braze material is provided to form a vertical braze joint 470, which stops at or before the braze material makes contact with rotor shaft chamfer seat 164. To do so, the cross-sectional area of the braze ring 168 (seen in FIG. 3) must be substantially equal to the cross-sectional area of the vertical braze joint 470 seen in FIG. 7. As such, the rotor shaft chamfer seat 164 is in contact with little or no braze material. One of ordinary skill in the art may calculate the amount of braze material needed by determining the cross-sectional area of the gap that forms the interface between the rotor shaft 112, and the rotor body 114, a representative portion of which is indicated in the hatched section of FIG. 7.

The fact that a given braze material will tend to show a greater affinity for either the rotor shaft 112 or rotor body 114 may be used as an advantage. For example, in one instance the particular braze material may be selected to have an affinity for, and tend to wet rotor body 114. When the braze material is applied to form vertical braze joint 470, the rotor shaft and rotor body assembly 110 may be inverted and a capillary action and wetting of the rotor body 114 by the braze material may be balanced against the force of gravity. Moreover, temperature control may be used to adjust the brazing process in order to achieve a vertical braze joint 470 that does not wet chamfer 156 and/or chamfer seat 164. This method of providing an amount of braze material so as to only form a vertical braze joint 470 and at the same time avoid the formation of any diagonal braze joint is one example of a step for resisting the formation of a braze joint with horizontal thermal shear.

Figure 8:
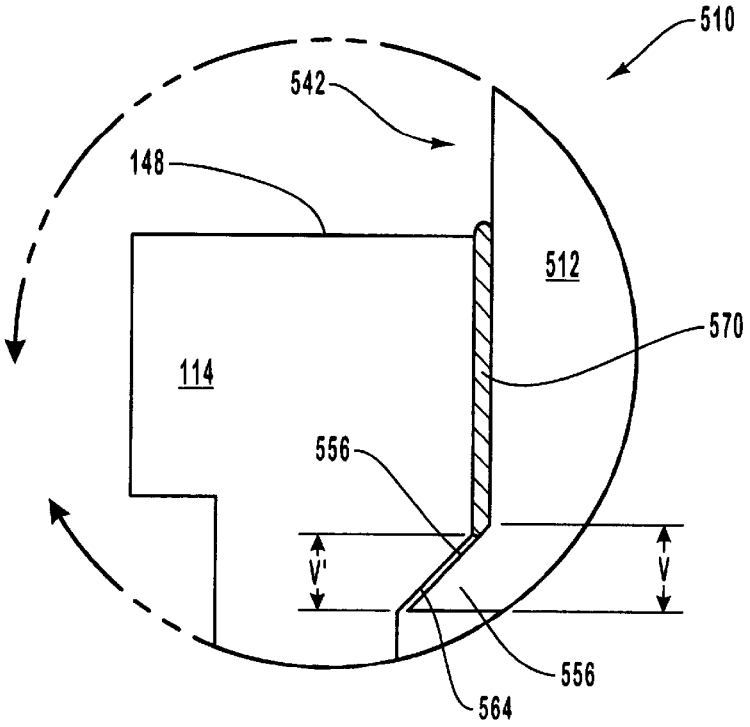
FIG. 8 is a detail section taken from a structure similar to that seen in FIG. 3, wherein an alternative embodiment depicts a vertical braze joint and a close contact between a chamfer and chamfer seat that restrict the flow of braze material therebetween.

Reference is next made to FIG. 8, which illustrates yet another embodiment. Here, a vertical braze joint 570, in the form of a cylindrical shell, is formed between the rotor shaft 512 and the rotor body 114. The vertical braze joint 570 has filled the space between the rotor shaft 512 and the rotor body 114 from the proximal surface 148 down to about the level of vertical height v of the rotor shaft chamfer 556. Also, the spacing between rotor shaft main section 542 and rotor body 114 is relatively larger than the spacing between rotor shaft chamfer 556 and rotor shaft chamfer seat 564. In the illustrated embodiment, the space or interface between the rotor shaft chamfer 556 and rotor shaft chamfer seat 564 is in the form of a frusto-cone shell.

The reduced spacing between rotor shaft chamfer 556 and rotor shaft chamfer seat 564 as compared to that between rotor shaft main section 542 and rotor body 114 reduces the amount of braze material needed between chamfer 556 and chamfer seat 564. Preferably, the spacing between chamfer 556 and seat 564 is less than 100 mils, and in a most preferred embodiment is less than about 10 mils. The first spacing (between 542 and 114) facilitates the flow of braze material, and the second spacing stops (or reduces) the flow of braze material. Preferably, the braze material between rotor shaft 512 and rotor body 114 comprises the entire vertical braze joint 570. This embodiment may also be fabricated by selecting an amount of braze material that will be equivalent to the area between rotor shaft 512 and rotor body 114 above the level of rotor shaft chamfer 556 and rotor shaft chamfer seat 564.

In the embodiment of FIG. 8, the interface between chamfer 556 and chamfer seat 564 involves two vertical heights v and v'. In this embodiment, v' is less than v. The process of selecting a braze material under sufficient flow conditions to form a braze joint and to braze such that substantially no braze material fills between rotor shaft chamfer 564 and rotor shaft chamfer seat 556 is another example of a step for resisting the formation of a braze joint with horizontal thermal shear.

Figure 9:
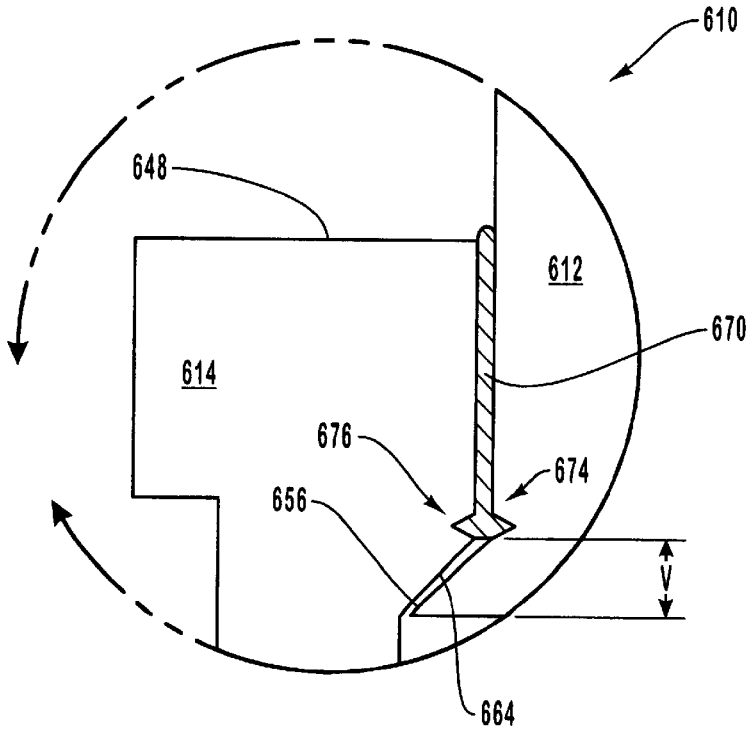
FIG. 9 is a detail section taken from a structure similar to that seen in FIG. 3, wherein an alternative embodiment illustrates a rotor body v-notch that acts as a stop or braze material well in order to achieve a vertical braze joint with no horizontal shear structures.

FIG. 9 illustrates yet another embodiment of the present invention. A vertical braze joint 670 is depicted as being between a rotor shaft 612 and a rotor body 614. Because capillary action of braze material under flow conditions may cause wetting to extend downwardly beyond the occurrence of the rotor shaft chamfer 656 and the rotor shaft chamfer seat 664, a rotor body depression such as a rotor body v-notch 676 and optionally a rotor shaft v-notch 674 may be provided. Either or both of these v-notches act as a braze material stop or well that will accumulate braze material and that will stop the downward flow of the braze material during the formation of vertical braze joint 670. Thus, a rotor shaft and rotor body assembly 610 comprises rotor shaft 612, rotor body 614, rotor shaft v-notch 674, and rotor body v-notch 676 into which vertical braze joint 670 has filled and has substantially stopped the downward flow of braze material during formation of the assembly.

Rotor shaft v-notch 674 or rotor body v-notch 676 may be configured at a level at or above vertical height v according to the specific application. Additionally, either v-notch can have an angular shape, or any other geometric configuration that may receive the excess braze material to a sufficient volume. In a preferred embodiment, the rotor shaft v-notch 674 and rotor body v-notch 676 may each have an angle in a range from about 90° to 30°, and most preferably about 60°. The configuration of rotor shaft v-notch 674 to act as a stop or braze material well is an example of a means for resisting the formation of a braze joint with horizontal thermal shear.

Figure 10:
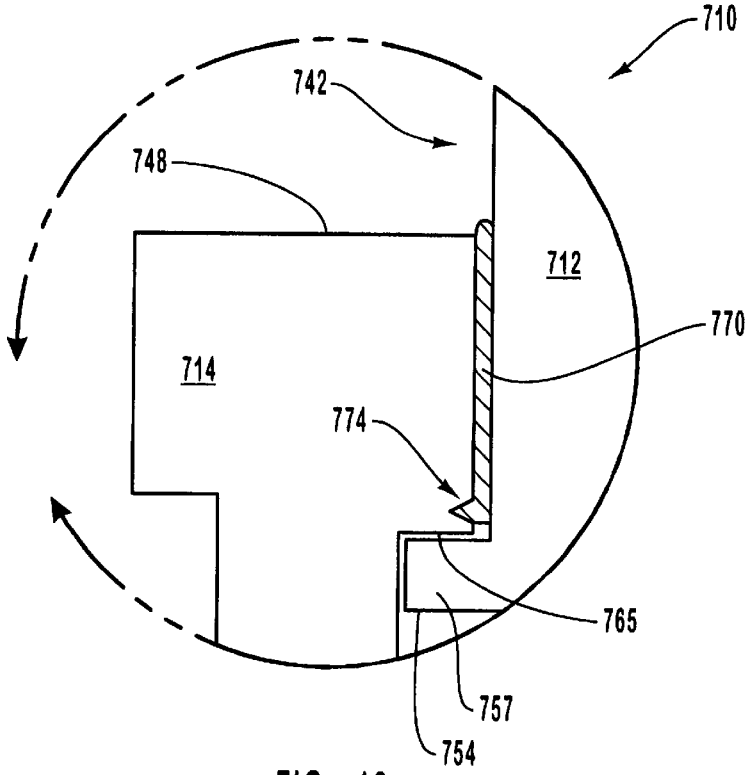
FIG. 10 is a detail section taken from a structure similar to that depicted in FIG. 3, wherein an alternative embodiment illustrates a flange at the proximal end of a rotor shaft and a v-notch cut into the rotor body that acts as a stop or well for braze material during the brazing of the shaft to the body.

FIG. 10 is a detail section taken from a structure at a location similar to that taken from FIG. 3 along the line 4—4 that illustrates yet another embodiment of the present invention. In place of a rotor shaft chamfer, a rotor shaft 712 may have an enlarged portion near the rotor shaft proximal end 754. In this embodiment, the enlarged portion is depicted as a flange 757. A vertical braze joint 770 is depicted as having filled against rotor shaft main section 742 beginning at proximal surface 748 and as having terminated at a rotor body v-notch 774. The rotor body 714 has a flange seat 765 that abuts against rotor shaft flange 757.

An alternative embodiment of the invention depicted in FIG. 10 is eliminates the rotor shaft v-notch 774. In this embodiment, an amount of braze material is selected so as to only form vertical braze joint 770, for example as is set forth for the embodiment depicted in FIG. 7. Additionally and/or alternatively, the spacing between rotor shaft main section 742 and rotor body 714 and rotor shaft flange 757 and flange seat 765 can be adjusted such that braze material flows to form vertical braze joint 770, but is prevented from forming any horizontal thermal shear joint between flange 757 and rotor body 714. In preferred embodiments, spacing between flange 757 and flange seat may be less than 100 mils, and most preferably less than 10 mils. Either or both of rotor body v-notch 774 and spacing between rotor shaft flange 757 and the abutting portion of rotor body 714 is another example of a means for resisting the formation of a braze joint with a horizontal thermal shear.

Figure 11:
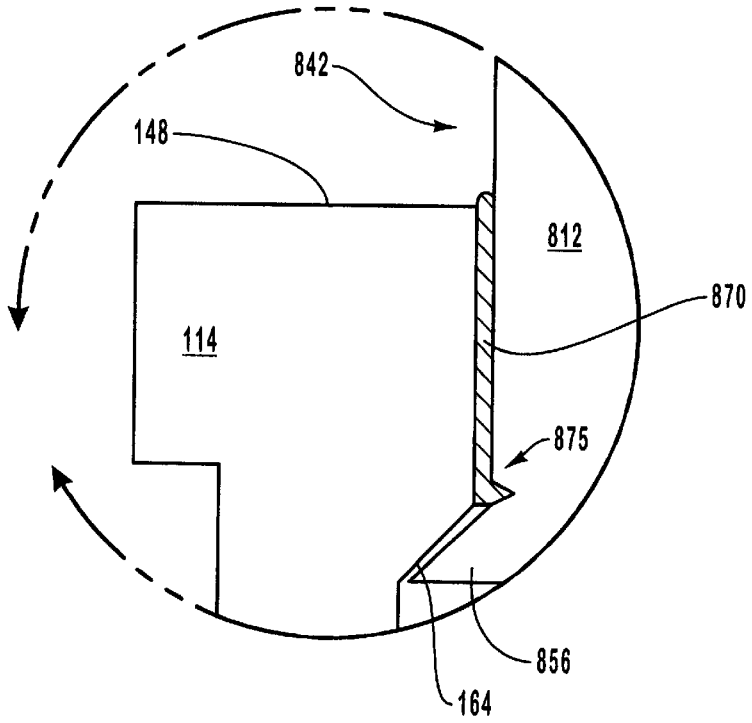
FIG. 11 is a detail section taken from a structure similar to that depicted in FIG. 3, wherein an alternative embodiment depicts a rotor shaft v-notch cut above the chamfer that acts as a braze material stop or well in order to achieve a vertical braze joint according to the present invention.

FIG. 11 is a detail section taken from a structure at a location similar to that taken from FIG. 3 along the line 4—4 that illustrates yet another embodiment of the present invention. In FIG. 11, it can be seen that rotor body 114 is coupled with a rotor shaft 812 that contains a depression such as a rotor shaft v-notch 875 that acts as a stop or well for braze material as it flows from proximal surface 148 downwardly in the direction of the rotor shaft chamfer 856 and rotor shaft chamfer seat 164. As with other embodiments previously set forth, spacing between rotor shaft main section 842 and rotor body 114 may be larger than spacing between rotor shaft chamfer 856 and rotor shaft chamfer seat 164 to control the flow of braze material. Where the braze material that is used to form vertical braze joint 870 has a wetting affinity for rotor body 114 greater than rotor shaft 812, greater care may be required to form vertical braze joint 870 without filling braze material into the space between rotor shaft chamfer 856 and rotor shaft chamfer seat 164. The presence of rotor shaft v-notch 875 as well as the optional close proximity between rotor shaft chamfer 856 and rotor shaft chamfer seat 164, that resists the flow of a selected amount of braze material beyond the occurrence of rotor shaft v-notch 875 is another example of a means for resisting the formation of a braze joint with horizontal thermal shear.

A depression such as a v-notch or another shape may be cut into either the rotor shaft or the rotor body, or both, in order to facilitate the formation of a vertical braze joint and avoid horizontal thermal shear planes. Additionally, other notch profiles may be formed such as a notch with a curvilinear cross-sectional profile as opposed to a notch with a rectilinear cross-sectional profile of a v-notch Other "notch" configurations that control the flow of braze material could also be used.

Presently preferred embodiments of the present invention utilize a PALCO® braze material under braze temperatures known in the prior art. Other materials could also be used.

To summarize, embodiments of the present invention have distinct advantages over that of the prior art. One advantage is that the parts are more easily machined because there is no thread-cutting operation, either for the rotor shaft where external threads were previously required, or for the rotor body where internal threads were previously required. As a result of the absence of threads, the parts are more easily machined and also easier to assemble.

Another distinct advantage is that no special welding or bonding techniques are required such as electron beam welding often required in the prior art. The absence of any special welding or bonding techniques also eliminates destructive embrittlement of the interface between the rotor shaft and rotor body. Another distinct advantage of embodiments of the present invention is that they eliminate substantially all thermal sheer stresses in the rotor braze joint. This greatly increases the operational life of the assembly.

Another distinct advantage of embodiments of the present invention is that the rotor shaft and rotor body assembly allows the x-ray tube to be operated at higher temperatures. Substantially no thermal sheer is experienced to compromise the integrity of the braze joint. Moreover, even if the braze joint is compromised, the rotor shaft and rotor body assembly will not de-couple because of the chamfer or flange feature that holds the assembly together regardless of the presence or absence of the braze joint.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray tube having a rotating anode, comprising:

a rotor shaft having a main section operatively connected to the rotating anode, and an engagement end having a predefined profile; and a rotor body having an axial bore formed therethrough, the bore having inner recess having a shape that is substantially complimentary to the shape of the profile of the engagement end, wherein a connection interface is provided between the rotor shaft and the rotor body when the engagement end is operably received within the inner recess.

2. An x-ray tube according to claim 1, wherein the profile of the engagement end is substantially convex in shape.

3. An x-ray tube according to claim 1, further comprising:

a braze joint that is substantially axially disposed between the rotor shaft and the rotor body along at least a portion of the connection interface.

4. An x-ray tube according to claim 1, wherein the engagement end is a flange.

5. An x-ray tube according to claim 1, further comprising:

a depression formed along at least a portion of the inner recess at a location substantially proximate to the connection interface.

6. An x-ray tube according to claim 1, further comprising:

a depression formed along at least a portion of the rotor shaft at a location substantially proximate to the connection interface.

7. An x-ray tube according to claim 1, wherein at least a portion of the inner recess has a size and a shape such that a tight compression fit is provided between the rotor shaft and the rotor body when the engagement end is received within the inner recess.

8. An x-ray tube according to claim 1, wherein at least a portion of the inner recess has a size and shape such that a gap is provided between the rotor shaft and the rotor body when the engagement end is received within the inner recess.

9. An x-ray tube according to claim 8, wherein the dimension of the gap is selected so that a predetermined amount of braze material is capable of being disposed within the connection interface.

10. An x-ray tube according to claim 8, wherein the width of the gap varies in a manner so as to substantially preclude braze material from being received within predetermined regions of the connection interface.

11. An x-ray tube comprising:

a rotary anode;

a rotor shaft having a first end operably attached to the rotary anode, and a second end having a predefined profile;

a rotor body having an axial bore passing through a central portion of the rotor body, wherein the axial bore includes a coaxial recess that is adapted to form a substantially complimentary mating surface with at least a portion of the rotor shaft and the second end of the rotor shaft; and a braze joint axially disposed along at least a portion of the mating surface between the rotor shaft, the second end and the recess in the rotor body.

12. An x-ray tube comprising:

a rotor shaft having a cylindrical main section that is axially disposed in an evacuated housing;

a rotor body axially disposed in the x-ray tube and having an axial bore formed therein that is capable of receiving the rotor shaft main section; and means for retaining the rotor shaft in the axial bore formed within the rotor body.

13. An x-ray tube according to claim 12, wherein the means for retaining the rotor shaft comprises a chamfer formed on an end of the rotor shaft that has a corresponding mating surface within the axial bore.

14. An x-ray tube according to claim 12, wherein the means for retaining the rotor shaft comprises a flange formed on an end of the rotor shaft that has a corresponding mating surface within the axial bore.

15. An x-ray tube according to claim 12, further comprising:

means for substantially resisting the formation of a braze joint having a horizontal thermal shear component.

16. An x-ray tube according to claim 15, wherein the means for substantially resisting the formation of a braze joint comprises at least one depression formed within the rotor body axial bore.

17. An x-ray tube according to claim 16, wherein the depression comprises a V-notch formed along the inner periphery of the rotor body axial bore.

18. An x-ray tube according to claim 15, wherein means for substantially resisting the formation of a braze joint comprises a depression formed along at least a portion of the outer periphery of the rotor shaft.

19. An x-ray tube according to claim 18, wherein the depression comprises a V-notch formed along the outer periphery of the rotor shaft.

20. A method of manufacturing a rotor body and a rotor shaft for use in an x-ray tube, the method comprising;

forming a rotor shaft with an engagement end having a predefined shape;

forming a rotor body with an axial bore having an inner recess that provides a complementary shape to that of the engagement end; and inserting a first portion of the rotor shaft through the rotor body axial bore until the engagement end forms a connection interface with the inner recess.

21. A method of manufacturing according to claim 20, further comprising the step of:

creating a temperature differential between the rotor shaft and the rotor body that is sufficient to allow the rotor shaft to pass through the axial bore, whereby a tight compression fit is provided between at least a portion of the engagement end and the inner recess when the temperature differential is removed.

22. A method of manufacturing according to claim 20, further comprising the step of:

brazing the rotor shaft to the rotor body in the region of the connection interface.

23. A method of manufacturing according to claim 22, wherein the brazing step comprises the steps of:

providing a braze ring to rest against the rotor shaft and against the rotor body; and heating the braze ring sufficient to cause it to flow between the rotor shaft and the rotor body in the region of the connection interface.

24. A method of manufacturing according to claim 22, wherein the brazing step comprises the steps of:

providing a braze ring that encircles the rotor shaft and rests upon the rotor body;

heating the braze ring to cause it to flow and to fill between the rotor shaft and the rotor body;

inverting the rotor shaft and the rotor body; and controlling the flow of the braze ring to form a braze joint having a predetermined orientation within the correction interface.

25. A method of manufacturing according to claim 20, further comprising the steps of:

providing a first gap between the rotor shaft and the axial bore in the region of the connection interface;

providing a second gap between the rotor shaft and the axial bore, wherein the second gap is smaller than the first gap; and flowing braze material into the first gap under conditions that the material fills the first gap but does not fill the second gap.

26. A method of manufacturing according to claim 20, further comprising the steps of:

causing braze material to flow between the rotor shaft and the rotor body in a predetermined region of the connection interface.

27. A method of manufacturing according to claim 20, wherein the braze material forms a braze joint that is substantially devoid of horizontal shear stress between the rotor shaft and the rotor body.

* * * * *

UNITED STATES PATENT AND TRADEMARK OFFICE

CERTIFICATE OF CORRECTION

PATENT NO. : 6,330,304 B1
APPLICATION NO. : 09/561730
DATED : December 11, 2001
INVENTOR(S) : Warburton It is certified that error appears in the above-identified patent and that said Letters Patent is hereby corrected as shown below:

Column 2
Line 31, after "appreciated", insert --that--
Line 41, after "due", insert --to--

Column 3
Line 22, before "cracks", remove [a]
Line 53, after "provide", change "a" to --an--

Column 4
Line 65, change "obtained" to --obtained is shown,--

Column 11
Line 45, after "v-notch", insert --.--

Column 12
Line 14, change "illustrated" to --illustrative--

Signed and Sealed this

Twenty-first Day of December, 2010

David J. Kappos

David J. Kappos
*Director of the United States Patent and Trademark Office*